US005086882A

United States Patent [19]

Sugahara et al.

[11] Patent Number: 5,086,882

[45] Date of Patent: Feb. 11, 1992

[54] ELEVATOR APPARATUS PROVIDED WITH GUIDING DEVICE USED FOR PREVENTING PASSENGER CAGE VIBRATION

[75] Inventors: Jun Sugahara; Hideaki Takahashi; Toshihiko Nara, all of Katsuta, Japan

[73] Assignee: Hitachi, Ltd., Tokyo, Japan

[21] Appl. No.: 574,093

[22] Filed: Aug. 29, 1990

[30] Foreign Application Priority Data

Aug. 30, 1989 [JP] Japan ..... 1-221487

[51] Int. Cl.[5] ..... B66B 7/04

[52] U.S. Cl. ..... 187/95; 187/1 R; 187/115

[58] Field of Search ..... 187/95, 1 R, 46, 115, 187/131

[56] References Cited

U.S. PATENT DOCUMENTS

| | | | |
|---|---|---|---|
| 1,854,976 | 4/1932 | Brady | 187/95 |
| 1,899,751 | 2/1933 | Dunlop | 187/95 |
| 1,936,780 | 11/1933 | Arnold et al. | 187/95 X |
| 2,100,169 | 11/1937 | Norton | 187/95 |
| 2,277,565 | 3/1942 | Spiro | 187/95 |
| 2,309,123 | 1/1943 | Kiesling | 187/95 |
| 3,554,327 | 1/1971 | Takamura et al. | 187/95 |
| 4,047,597 | 9/1977 | Okura et al. | 187/95 |
| 4,660,682 | 4/1987 | Luinstra et al. | 187/1 R |
| 4,750,590 | 6/1988 | Otala | 187/95 |

*Primary Examiner*—Robert P. Olszewski
*Assistant Examiner*—Dean A. Reichard
*Attorney, Agent, or Firm*—Antonelli, Terry, Stout & Kraus

[57] ABSTRACT

An elevator apparatus provided with a guiding device for guiding a passenger cage without vibration with respect to the guide rails. Sensors are provided so that a pressure applied to the guiding device from the guide rails is maintained constant, and an actuator is driven by an output of the sensor. The sensor may be a pressure sensor and, as the output of the sensor increases, the distance between the guide rail and the passenger cage is controlled in a manner so as to be decreased. The guiding device immediately follows the bend of the guide rail and an unbalanced load of the passenger cage so that transversal vibration of the passenger cage is considerably reduced.

16 Claims, 10 Drawing Sheets

ELEVATOR APPARATUS PROVIDED WITH GUIDING DEVICE USED FOR PREVENTING PASSENGER CAGE VIBRATION

BACKGROUND OF THE INVENTION

The present invention relates to an elevator apparatus and, more particularly, to guiding devices for a passenger cage used for preventing vibration.

A slight bend determined by the installation accuracy is produced on the guide rails for a passenger car of an elevator which are vertically provided in an elevator shaft.

Further, the building in which an elevator is installed gradually contracts under the weight of various equipments. If the building is multistoried, the amount of contraction increases, and the guide rails are further bent by the compression caused by the contraction of the building. If the bend of the guide rails increases, transversal vibration is caused during the upward and downward travel of the passenger cage. As the elevator travels at a higher speed, the transversal vibration the passengers feel becomes stronger, with the transversal vibration making the passengers not only uncomfortable but also uneasy.

Conventional guiding devices for guiding the passenger cage with rollers (wheels) contacting guide rails are proposed in Japanese Patent Laid-Open No. 74897/1987. In this proposal, an actuator is directly attached to the rollers (wheels), and the actuator is operated on the basis of the data on the bend on the guide rails which are measured and stored in advance by an acceleration detector, thereby reducing the transversal vibration of the passenger cage which is caused by the bend of the guide rails.

Another proposal is described in Japanese Patent Publication No. 39753/1983. In this proposal, the guiding devices which engage with the guide rails in a non-contacting state are provided, and apart from the guide rails, a vertical reference line is provided, whereby the guiding devices in the state of being non-contacting with the guide rails are so controlled that the distance between the reference line and the passenger cage is constant, thereby reducing the transversal vibration of the passenger cage.

Of the above-described prior art, in the proposal of Japanese Patent Laid-Open No. 74897/1987, it is assumed that the bend on the guide rails is constant irrespective of the unbalanced loading on the passenger cage due to the passengers and it no consideration is given to the fact that the bend on the guide rails actually changes in dependence upon the unbalanced loading condition. Thus, it is not always possible to reduce the transversal vibration of the passenger cage. In addition, change of the bend on the guide rails with time in the period from the time when the data on the bend in the guide rails is stored to the time when the data on the bend is rewritten by the remeasurement, the transversal vibration of the passenger cage is increased and deteriorated with time during this period. This proposal in which the guiding devices are directly driven by the actuator also involves a fear of the guiding devices decoupling from the guide rails when the actuator is out of order.

In the proposal of Japanese Patent Publication No. 39753/1983, it is necessary to provide the vertical reference line apart from the guide rails, so that the installation of the elevator is troublesome. In addition in this system, the guiding devices engage with the guide rails in a non-contacting state. However, when unbalanced load due to the passengers in the passenger cage or the impact load such as an earthquake is applied to the passenger cage, the non-contacting guiding devices solely cannot bear the load and require a back-up guiding device, which makes the elevator apparatus complicated.

SUMMARY OF THE INVENTION

Accordingly, it is an object of the present invention to provide an elevator apparatus provided with passenger cage guiding devices which are constantly capable of reducing the transversal vibration of the passenger cage.

It is another object of the present invention to provide an elevator apparatus provided with highly safe passenger cage guiding devices which are constantly capable of reducing the transversal vibration of the passenger cage.

It is still another object of the present invention to provide an elevator apparatus provided with passenger cage guiding devices which are constantly capable of reducing the transversal vibration of the passenger cage by a simple structure irrespective of the unbalanced loading on the passenger cage or a change of the guide rails with time.

To achieve these ends, in the present invention, a guiding device is provided with a means for making the pressure applied to the guiding device from the guide rail constant.

To state this more concretely, the guiding device is provided with an actuator in such a manner as to be situated between a roller or a sliding shoe which comes into contact with the guide rail and the passenger cage.

The distance between the roller or sliding shoe and the passenger cage is varied in accordance with the bend on the guide rails and the unbalanced loading of the passenger cage. For example, by making the distance small when the output of the pressure sensor becomes large, it is possible to keep the pressure applied to the guiding device from the guide rail constant.

The bend on the guide rails gradually changes and the guide rails greatly warp above and below the guide rail attaching brackets. The unbalanced loading on the passenger cage changes every time the passenger cage stops at an elevator hall.

According to the present invention, since it is possible to follow the change in bend on the guide rails and unbalanced loading on the passenger cage, the transversal vibration of the passenger cage is greatly reduced.

DETAILED DESCRIPTION

Figure 1:
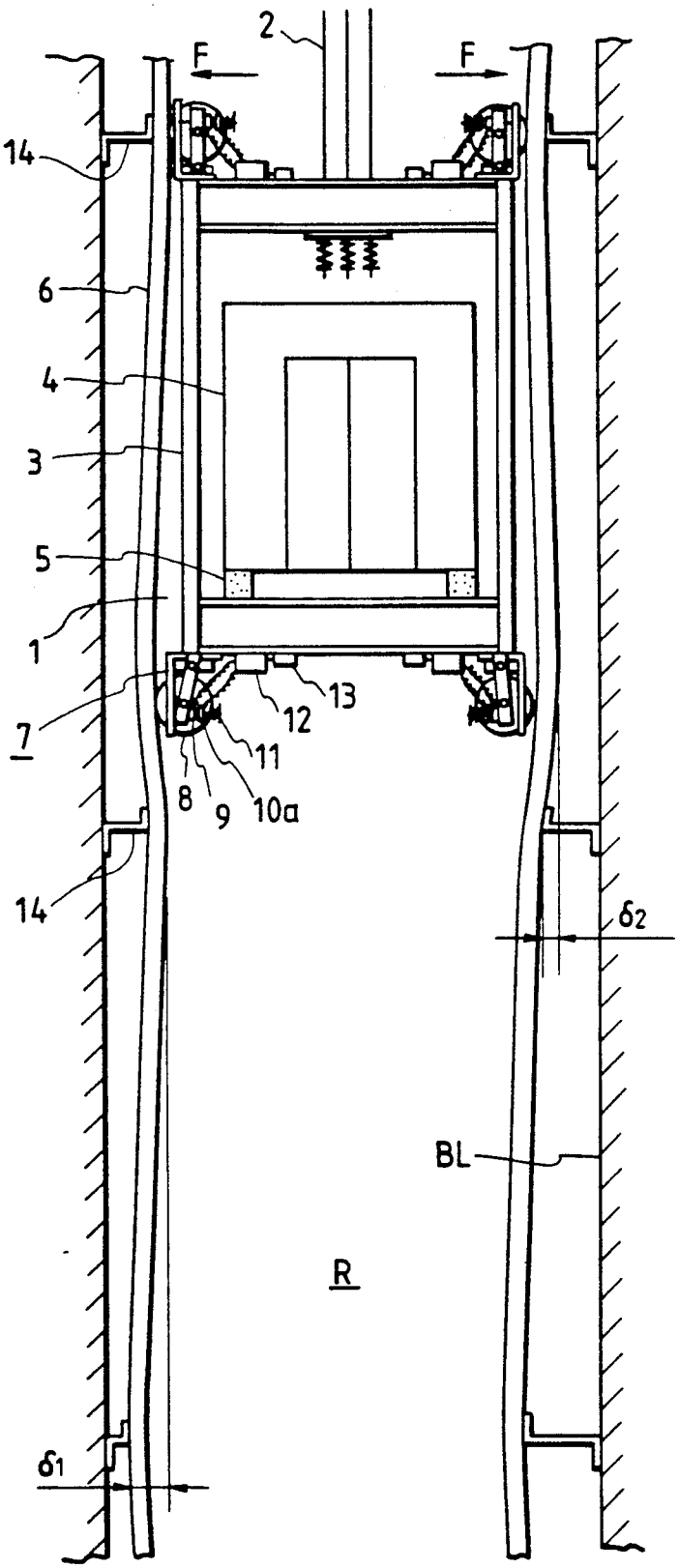
FIG. 1 is a schematic view of a first embodiment of an elevator according to the present invention.

As shown in FIG. 1, an elevator 1 is provided with guiding devices 7, with a cage frame 3 being vertically moved by four roller-guiding type guiding devices provided at upper, lower, right-hand and left-hand portions, respectively while being engaged with and guided by a pair of opposing guide rails 6 vertically provided on the wall surface of an elevator shaft R in a building BL. A passenger cage 4 is supported by the cage frame 3 through a rubber vibration insulator 5 in a vibration-proof manner. The cage frame 3 is vertically moved by a rope 2. The guide rail 6 has a bend $\delta_1$ which is determined by the installation accuracy, and the bend 61 gradually increases with time due to the contraction of the building after the completion, the repetitive bending of the building due to wind or the like. The guide roller 8 of the guiding device 7 is constantly in contact with the guide rail 6 and pressed thereagainst through an elastic member 11 with a light pressing force F so as to prevent the passenger cage 4 from decoupling from the guide rail 6. Since the flexural rigidity of the guide rail 6 is very different between at the portion of the rail bracket 14 and at the other portion, the guide rail 6 between the rail brackets 14 subjects to elastic deformation by the amount of $\delta_2$ only when the guide roller 8 passes the guide rail 6. The amount $\delta_2$ of elastic deformation is increased by, for example, the an unbalanced load in the passenger cage 4.

Figure 2:
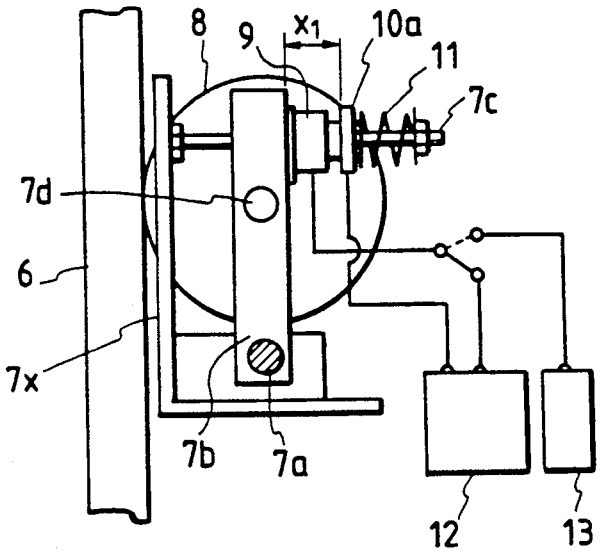
FIG. 2 is a schematic side view of a guiding device used for the elevator shown in FIG. 1.

Each guiding device 7 is composed of a guiding device mounting 7x fixed on the cage frame 3, a lever 7b rotatably attached to the mounting 7x by a pin 7a, a rod 7c provided on the guiding device mounting 7x substantially perpendicular to the guide rail 6, a guide roller 8 rotatably attached to the lever 7b by a shaft 7d, an actuator 9 provided on the lever 7b, a sensor 10a provided between the actuator 9 and the end of the rod 7c and an elastic member 11, as shown in detail in FIG. 2. One example of the actuator 9 is an electro-magnetic type, in which the coil and magnet are respectively coupled with the lever 7b and the rod 7c. Specifically, the magnet is secured to the rod 7c so as to surround the rod 7c, and the coil is secured to the lever 7c so as to surround the magnet. In response to the direction of current flowing through the coil, the magnet is pulled toward the lever 7b or conversely is driven away therefrom.

The contact pressure between the guide rail 6 and the guide roller 8 is transmitted to the pressure sensor 10a through the shaft 7d, the lever 7b, the actuator 9 and the elastic member 11 by the structure in which one end of the lever 7b is fixed on the guiding device mounting 7x by the pin 7a and the rod 7c is fixed on the guiding device 7x.

The output of the pressure sensor 10a is input to a controller 12 disposed on the cage frame 3, and the controller 12 drives the actuator 9 so as to adjust the space $x_1$ between the lever 7b and the pressure sensor 10a. A resistor 13 is fixed on the cage frame 3 in such a manner so as to be connected to the actuator 9 when the actuator 9 is not controlled.

The actuator 9 and the controller 12 are driven by utilizing electric power supplied through a tail cord (not shown) for the purpose of opening and closing the door of the passenger cage 4 or the like.

Figure 3:
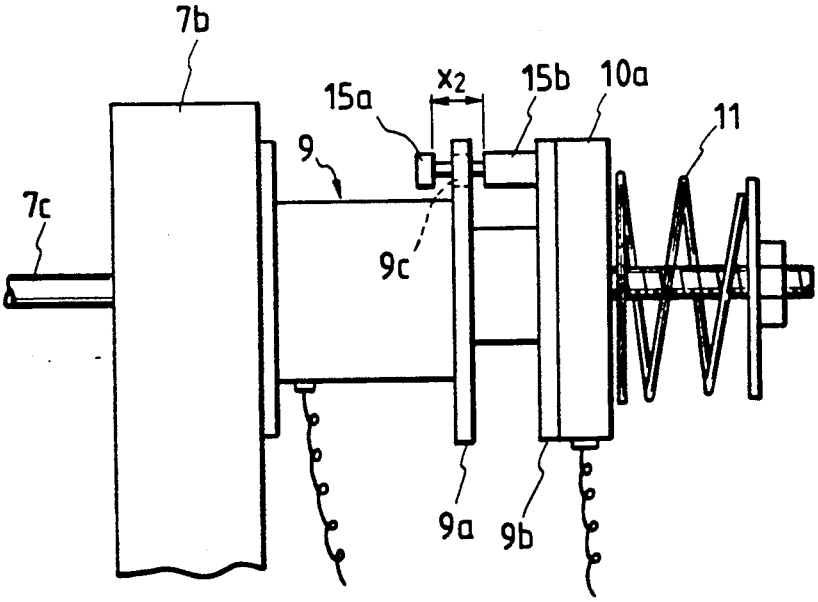
FIG. 3 is an enlarged schematic side view of an actuator of the guiding device shown in FIG. 2.

A stopper block 15b is provided on a flange 9b on the driven side which fixes the pressure sensor 10a, and a stopper engaging hole 9c is provided on a flange 9a on the driving side, as shown in FIG. 3. A stopper bolt 15a is fixed on the stopper block 15b through the stopper engaging hole 9c. The diameter of the head portion of the stopper bolt 15a and the outer diameter of the stopper block 15b are larger than the inner diameter of the engaging hole 9c, so that the flange 9a on the driving side is operational only in the space $x_2$ between the head portion of the stopper bolt 15a and the stopper block 15b, thereby regulating the sphere of action of the actuator 9.

Figure 4:
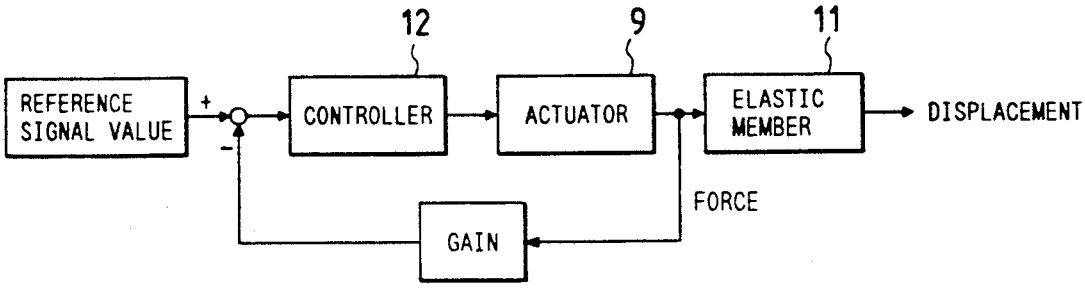
FIG. 4 is a block diagram for controlling the guiding device shown in FIG. 2.

These upper, lower, right-hand and left-hand guiding devices 7, four in total, are operated in accordance with the block diagram shown in FIG. 4. The controller 12 drives the actuator at a value obtained by subtracting a signal value which is obtained by multiplying the value detected by the pressure sensor 10a through the elastic member 11 by a certain gain from the reference signal value obtained from the pressure sensor 10a while the elevator stops at respective floors and held at the value during the movement of the elevator 1 so that the force applied to the elastic member 11 is constant.

One example of the controller 12 is one which applies microcomputer technology and includes a control unit and a drive unit. The control unit obtains current value and its direction through which the actuator 9 is operated based upon the deviation between the reference signal value and the output (multiplied by the gain) of the pressure sensor, and the drive unit outputs the current to be conducted through the actuator based upon that result.

The gain is for adjusting whether all of the output of the pressure sensor 10a is fed back or not, that is an adjusting gain for stabilizing the control. Further, the reasons why the output from the pressure sensor 10a during standstill of the elevator 1, more specifically during standstill immediately before its start is selected as the reference signal value is that the unbalanced load in the passenger cage is compensated by using the static load applied to the respective guiding device under the condition determined by the loaded articles and the location of the passengers within the passenger cage.

Figure 5:
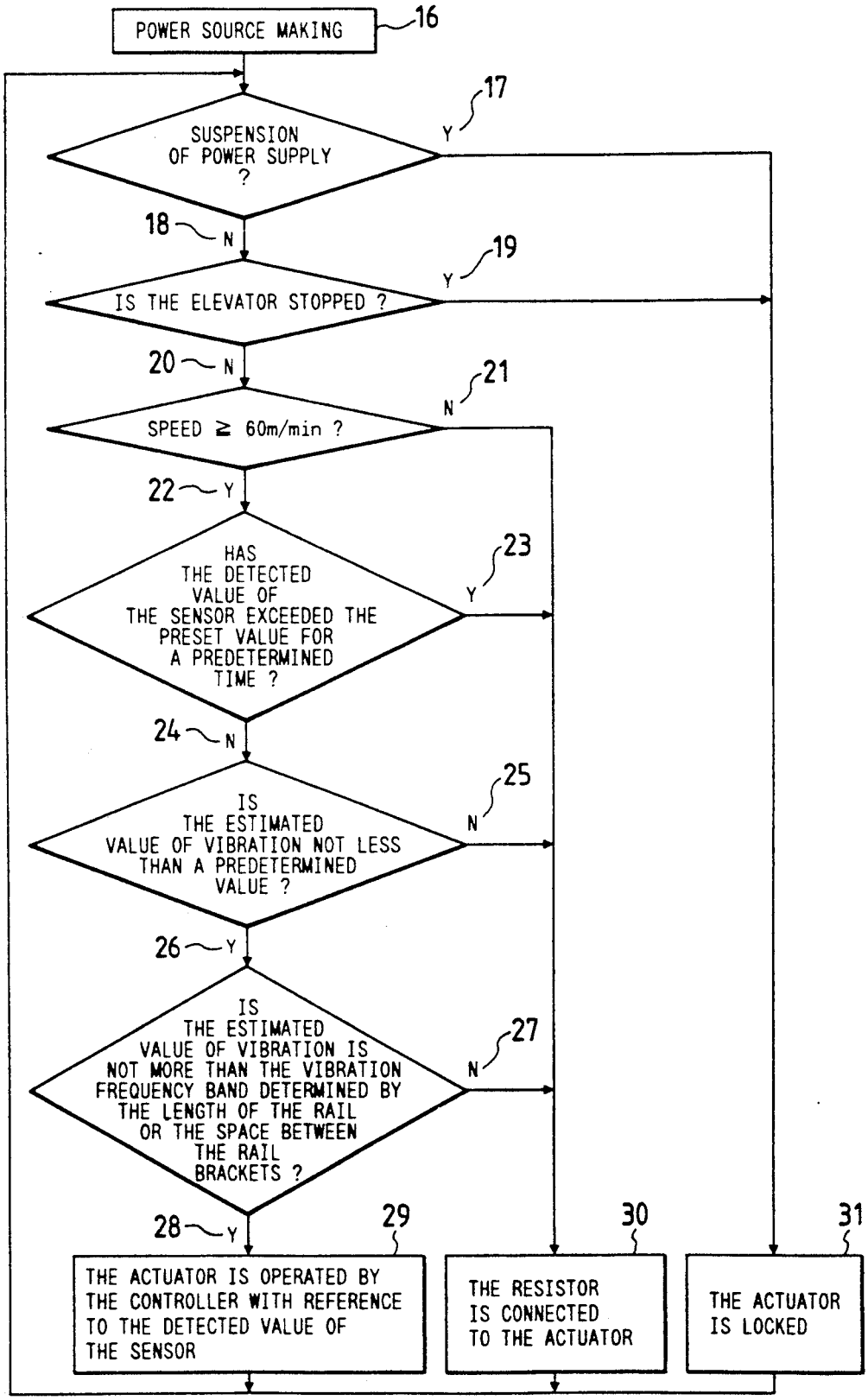
FIG. 5 is a flow chart for controlling the guiding device shown in FIG. 2.

The controller 12 and the actuator 9 are driven when the conditions in the flowchart shown in FIG. 5 are satisfied. More specifically, the actuator 9 is controlled (step 29) only when the power source for the elevator is made (step 16), the power supply is not suspended (step 18N), the elevator is running (step 20N), the speed of the elevator is not lower than 60m/min (step 22Y), the detected value of the force applied to the elastic member 11 has not exceeded a preset value for a predetermined time (step 24N), the estimated value of vibration on the floor of the passenger cage 4 is not less than a predetermined value (step 26Y), and the frequency of the detected value of the force applied to the elastic member 11 is less than the forced vibration frequency band determined by the length of the rail of the space between the rail brackets (step 28Y). The actuator 9 is locked when the power supply is suspended (step 17Y) or the elevator is stopped (step 19Y). When the speed is less than 60m/min (step 21N), the detected value of the force applied to the elastic member 1 has exceeded the preset value for the predetermined time (step 23Y), the estimated value of vibration on the floor of the passenger cage 4 is less than a predetermined value (step 25N), or the frequency of the detected value of the force applied to the elastic member 11 is less than the forced vibration frequency band determined by the length of the rail or the space between the rail brackets (step 27N), the actuator 9 is separated from the controller 12 and connected instead to the resistor 13 (step 30), thereby using the actuator 9 as an electric damper. This electric damper utilizes the coil and the magnet of the actuator as a generator, and by connecting a resistor circuit 13 into the coil such effect as the resistor damping in a motor is induced.

When the controller 12 controls the actuator 9 (step 29), if the passenger cage 4 is inclined clockwise due to the bends $\delta_1$, $\delta_2$ on the guide rail 6 or the unbalanced load in the passenger cage 4, the force applied to the pressure sensors 10*a* in the left upper and the right lower guiding devices 7 is increased, and the force applied to the pressure sensors 10*a* in the right upper and the left lower guiding devices 7 is decreased. Each controller 12 so controls the corresponding actuator 9 as to make the pressure applied to the corresponding pressure sensor 10*a* constant. In other words, the actuators 9 in the left upper and the right lower guiding devices drive the corresponding flanges 9*b* on the driven side so as to reduce the space $x_1$ shown in FIG. 2, while the actuators 9 in the left lower and the right upper guiding devices drive the corresponding flanges 9*b* on the driven side so as to enlarge the space $\delta_1$. Due to this operation, the left upper and the right lower portions of the passenger cage 4 are brought close to the guide rails 6. That is, the relative distance in the transverse direction between the passenger cage 4 and the guiding device 7, especially, the shaft 7*b* is reduced and the relative distance between the passenger cage 4 and the guiding device 7 at the right upper and the left lower portions is enlarged. In this way, the passenger cage 4 is inclined in a counterclockwise direction by each actuator 9, so that the inclination of the passenger cage 4 caused by the bend on the guide rails 6 and the unbalanced loading of the passengers o the like in the passenger cage 4, namely, the transversal vibration, is suppressed.

The suppression of the transversal vibration is carried out immediately in correspondence with the amount of abnormal pressure detected by each pressure sensor 10*a*. Therefore, even if the guide rail 6 gradually bends with time and whatever positions the passengers may occupy, the passenger cage 4 moves vertically upwardly and downwardly in the elevator shaft R without causing transversal vibration, thereby making the passengers comfortable. Since there is no transversal vibration, the passengers do not feel uneasy.

If there is no unbalanced load in the passenger cage 4, the pressure sensor 10*a* only detects the bend on the guide rail 6. The actuator 9 for adjusting the relative distance, as described above, adjusts the distance between the passenger cage 4 and the guide rail 6 in the transverse direction.

Since the actuator 9 is controlled only when the predetermined conditions are satisfied and in the other cases, it constitutes a passive damper structure such as the electric damper as mentioned above, thereby increasing the controlling stability and preventing the generation of abnormal vibration.

Further, in a high-frequency region of more than double of the above forced vibration frequency band in which the responsiveness of the actuator 9 becomes inferior and the controlling stability is lowered, the actuator is not controlled but functions as the passive damper, and as well the elastic member 11 functions as a vibration insulating member, which displays a sufficient vibration insulating capacity for reducing the transversal vibration of the passenger cage 4.

During power supply suspension, no current flows through the actuator coil, as the result, the actuator is freed from the control.

When the power supply is suspended or the elevator is stopped, the actuator 9 is locked so as to prevent excessive displacement of the passenger cage 4, thereby enhancing the safety. One of the examples of this actuator lock is a brake disposed on the coil side, and the brake is adopted to catch the magnet. During current conduction, the brake is freed and in association with power supply suspension the brake is closed to catch the magnet, to stop the movement of the rod 7*c*, and to prevent an excessive displacement of the passenger cage.

By providing the stoppers 15*a*, 15*b* for regulating the displacement on the actuator 9, it is possible to prevent excessive displacement even at an abnormal time such as the time when the actuator 9 is out of order. Thus, the elevator apparatus of the present invention is highly safe. In this instance, the elastic member 11 suppresses the displacement, and further, the guide roller 8 presses the guide rail 6, the roller 8 is unlikely to decouple from the rail 6.

Figure 6:
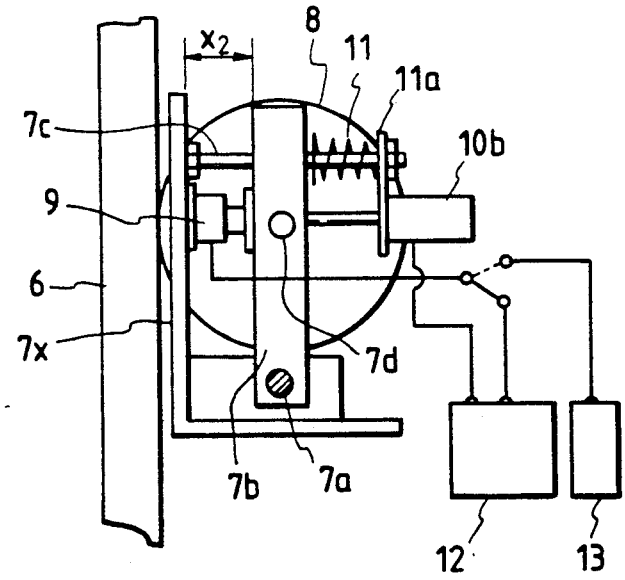
FIG. 6 is a schematic side view of a guiding device in a second embodiment according to the present invention.

In the embodiment of FIG. 6, the actuator 9 is disposed between the guiding device mounting 7*x* and the lever 7*b*, and the elastic member 11 is disposed between the lever 7*b* and the right end of the rod 7*c*. A displacement sensor 10*b* such as a potentiometer is provided between the connecting end 11*a* of the elastic member 11 to the rod 7*c* and the lever 7*b*.

The axial end of the displacement sensor 10*b* is press-contacted to the lever 7*b* via such as a spring not shown.

The sensor 10*b* detects the displacement of the elastic member 11, namely, the pressure applied thereto through the elastic member 11, and the actuator 9 adjusts the space $x_2$ between the lever 7*b* and the guiding device mounting 7*x* so that the detected pressure is constant.

Figure 7:
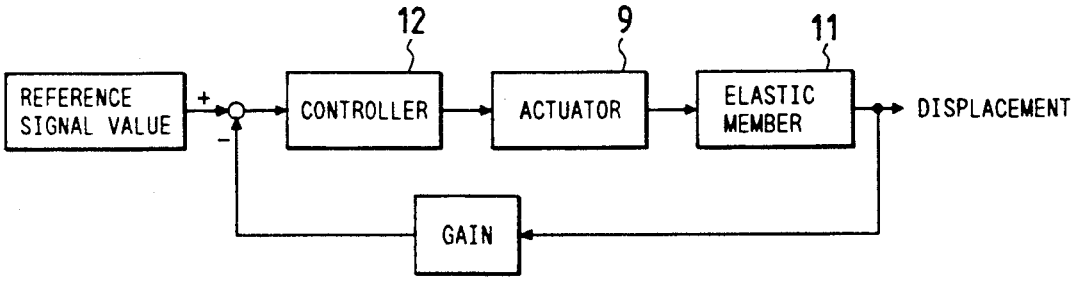
FIG. 7 is a block diagram for controlling the guiding device shown in FIG. 6.

The guiding device portion is operated in accordance with the block diagram shown in FIG. 7. The controller 12 drives the actuator at a value obtained by subtracting a signal value which is obtained by multiplying the detected value of the displacement of the elastic member 11 by a certain gain from the reference signal value obtained while the elevator stops, so that the force applied to the elastic member 11 is constant.

Figure 8:
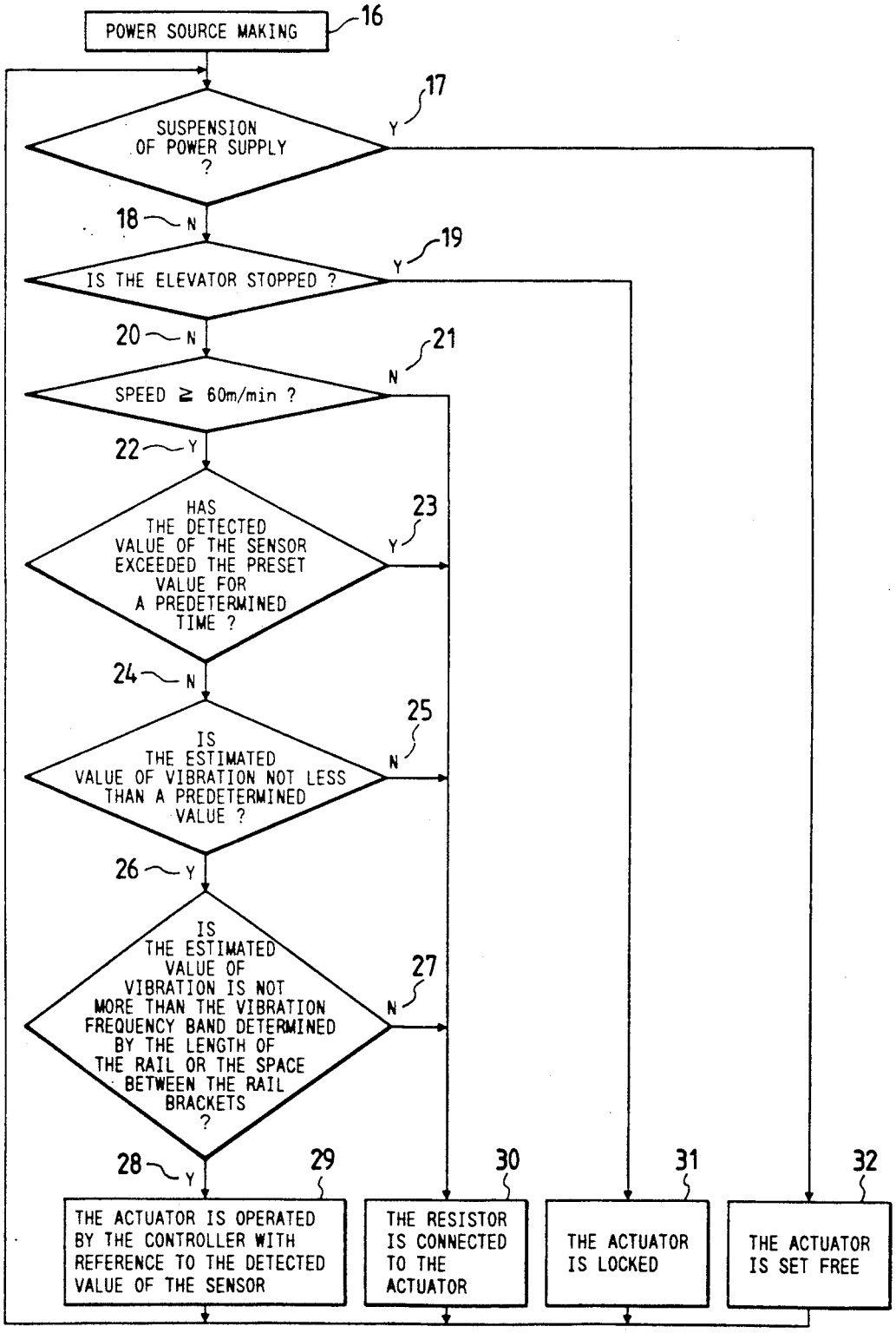
FIG. 8 is a flow chart controlling the guiding device shown in FIG. 6.

The controller 12 and the actuator 9 are driven in accordance with the flowchart shown in FIG. 8. The operational pattern in this flowchart is the same as that in the first embodiment shown in FIG. 5 except that the actuator 9 is freed (step 32) when the power supply is suspended (step 17Y) after the power source for the elevator is made (step 16).

This embodiment brings about the same advantages as the first embodiment.

In addition, since the actuator 9 and the elastic member 11 are provided in parallel to each other, the initial pressing force for pressing the guide roller 8 against the guide rail 6 and a large force such as the force applied from the unbalanced load in the passenger cage 4 to the guide roller 8 are received by the elastic member 11 and only a minute variable force component, generated by the vibration during running, is received by the actuator 9, so that it is possible to reduce the capacity of the actuator.

Figure 9:
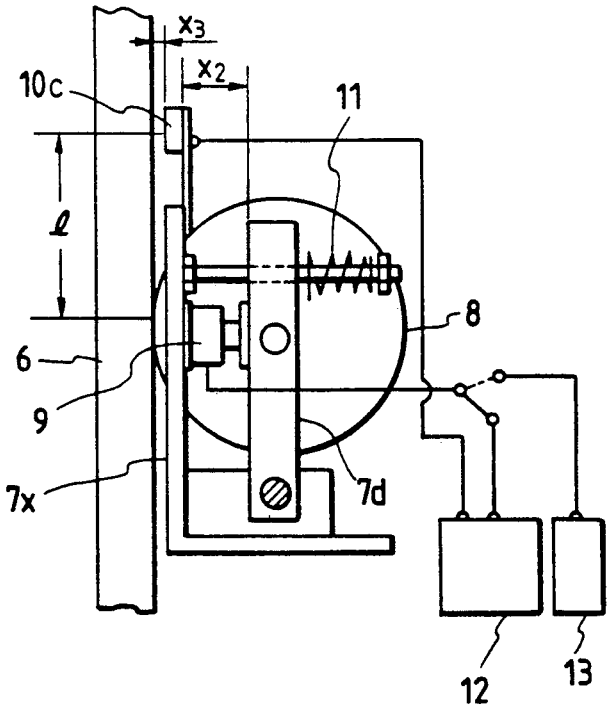
FIG. 9 is a schematic side view of a guiding device in a third embodiment according to the present invention.

In FIG. 9, the guiding device 7, unlike the embodiment of FIG. 6, is provided with a non-contacting displacement sensor 10*c* such as a laser displacement meter at a position before the guide roller 8 by a distance of l in place of the displacement sensor 10*b* for the elastic member. The non-contacting sensor 10*c* detects the displacement (space) $x_3$ between the guide rail 6 and the actuator adjusts the space $x_2$ between the lever 7*b* and the guiding device mounting 7*x* so that the displacement on the elastic member 11, namely, the force applied to the actuator through the elastic member 11 when the actuator travels by the space of l is always constant.

Figure 10:
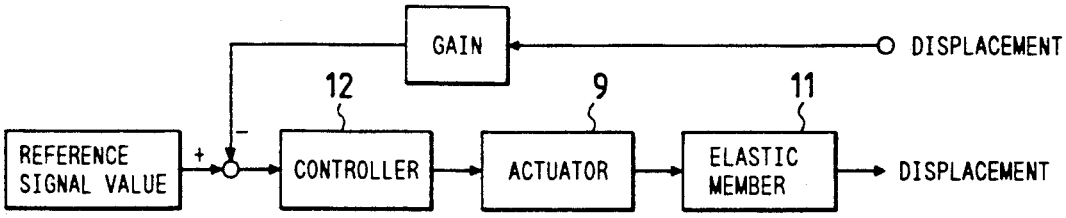
FIG 10 is a block diagram for controlling the guiding device shown in FIG. 9.

The guiding device portion operates in accordance with the block diagram shown in FIG. 10. The controller 12 temporarily stores in the internal memory in the controller 12 the value obtained by subtracting a signal value which is obtained by multiplying the detected value of the displacement of the guide rail at the position before the guide roller 8 by the distance l by a certain gain from the reference signal value obtained while the elevator stops, and the time $t_0$ required for the elevator to travel the distance l is calculated from the elevator speed. The signal value stored in the memory is read out after time $t_1$ which is obtained by subtracting the response delay time $t_d$ in the control system as a whole from the time $t_0$ and the actuator 9 is driven at the signal value read out so that the force applied to the elastic member 11 is made constant.

According to this embodiment, the same advantages as those of the second embodiment are obtained.

By providing the sensor 10*c* at a position prior to the guide roller 8, it is possible to reduce the response delay time of the control system as a whole to zero, thereby producing a very stable control system which does not produce abnormal vibration.

Figure 11:
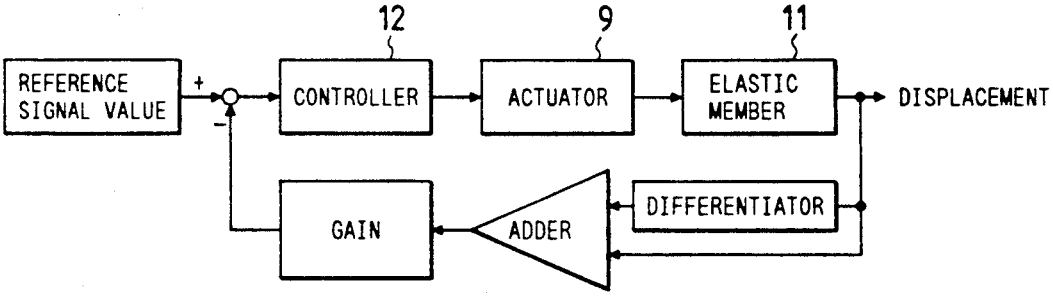
FIG. 11 is a block diagram for controlling a guiding device in a fourth embodiment according to the present invention.

FIG. 11 is a block diagram of the operation of a guiding device of a fourth embodiment of the present invention. The value of displacement of the elastic member 11 after the response delay time $t_d$ of the control system as a whole is estimated from the displacement signal of the elastic member 11 and the differentiated value of the signal value. The actuator is driven at a value obtained by subtracting a signal value which is obtained by multiplying the estimated value by a certain gain from the reference signal value obtained while the elevator stops, so that the force applied to the elastic member 11 supports the guide roller 8 is always constant.

This embodiment also brings about similar advantages to those of the second embodiment.

In addition, since the actuator 9 is controlled by predicting the displacement of the elastic member 11, it is possible to reduce the response delay time of the control system as a whole to zero, and the same advantages as those of the third embodiment are also obtained.

Figure 12:
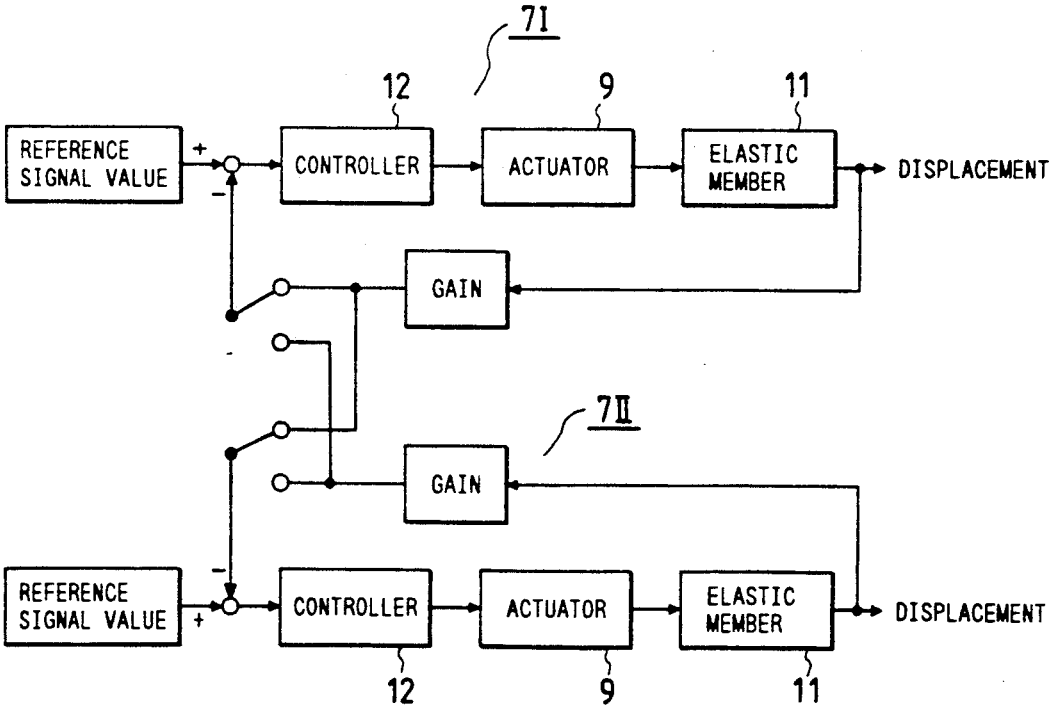
FIG. 12 and FIG. 13 are block diagrams for controlling a guiding device in fifth embodiment according to the present invention, when the elevator is moving upward and downward respectively.
Figure 13:
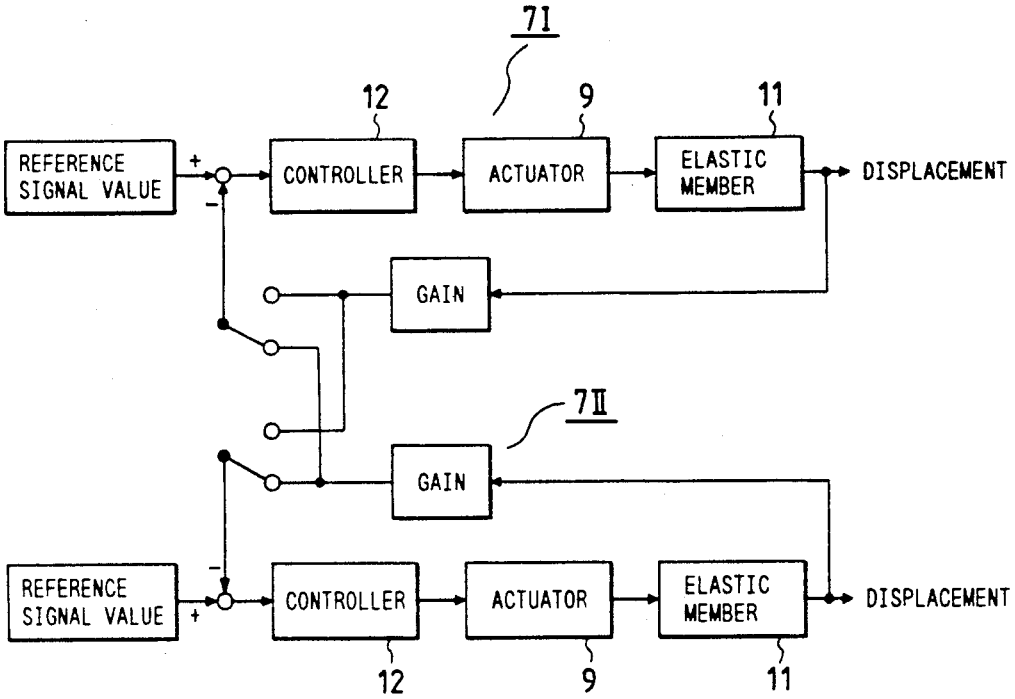

In the fifth embodiment of FIG. 12, the elevator is moving upwardly. With regard to the two rails in right and left, as shown in FIG. 1, when upper and lower guiding devices contacting the same rail are paired, the signal value obtained by multiplying the detected value of a change sensor of an upper guiding device 7 I by a certain gain is fed back to the controller 12 of the upper guide portion at real time and is stored in a memory not shown included in the controller 12 of a lower guiding device 7 II. When the lower guiding device 7 II passes the same guide rail portion after a predetermined time, the actuator of the lower guiding device 7 II is driven at a value obtained by subtracting the signal value from the reference signal value obtained while the elevator stops. In FIG. 13, the elevator is moving downward. The lower guiding device 7 II operates in a similar manner to the operation of the upper guiding device 7 I during the upward travel of the elevator. In this operation, a memory (not shown) of the controller 12 of the upper guiding device 7 I is used in the same manner as the memory of the controller 12 of the lower guiding device 7II during the upward travel of the elevator.

In addition to the advantages of the second embodiment, according to the embodiment of FIGS. 12 and 13, it is possible to greatly improve the responsiveness of the control system of the lower guiding device 7 II during the upward travel of the elevator and the responsiveness of the control system of the upper guiding device 7 I during the downward travel of the elevator, thereby enhancing the controlling stability.

Figure 14:
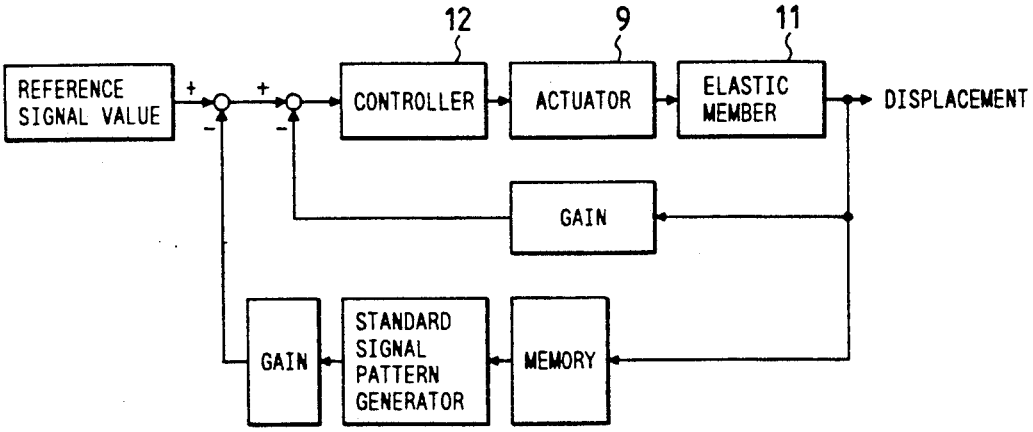
FIG. 14 is a block diagram for controlling a guiding device in sixth embodiment according to the present invention.

FIG. 14 is a block diagram of the operation of a sixth embodiment of the present invention.

A plurality of operations of storing a value with regard to the bend of the guide rail 6 detected by a displacement sensor of a guiding portion as a signal pattern in correspondence with the position of the elevator in a memory 61 included in the controller 12 are repeated while the elevator travels from the bottom floor to the top floor, and the plurality of signal patterns are averaged as a standard signal pattern with a standard signal pattern generator 62 (also included in the controller 12). When the standard signal pattern is produced and stored, the signal value at the portion corresponding to the position of the traveling passenger cage is read out of the standard signal pattern and the actuator is driven at a value which is obtained by subtracting not more than 80% of the thus-obtained signal value from the reference signal value obtained while the elevator stops, and subtracting from the thus-obtained difference a value obtained by multiplying the detected value of the displacement sensor by a certain gain.

In addition to the advantages of the second embodiment, according to this embodiment, since it is possible to reduce the amount of moving the actuator at real time measurement, the responsiveness of the actuator is enhanced and the stability of control system is improved.

Figure 15:
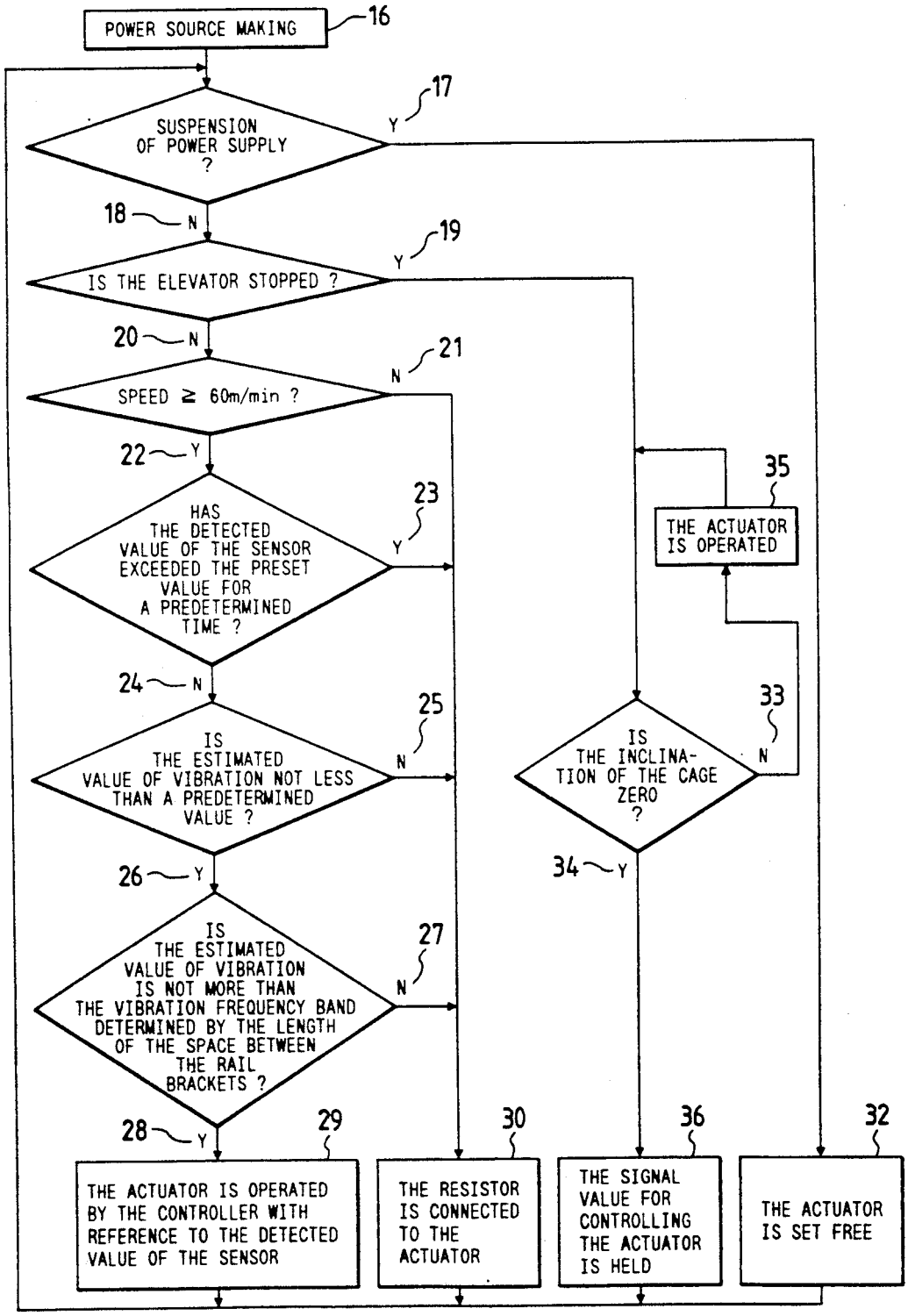
FIG. 15 is a flow chart for controlling a guiding device in seventh embodiment according to the present invention.

FIG. 15 is a flowchart of the controller and the actuator of a guiding device of a seventh embodiment of the present invention which is an improvement of the embodiment shown in FIG. 8. When passengers get in the passenger cage during the halt of the elevator and the unbalanced load produces a reaction force on the guiding portion, and an inclination of the passenger cage is generated (33N), the actuator is operated (step 35) until the inclination of the passenger cage becomes zero (step 34). When the inclination of the passenger cage becomes zero, the signal value for controlling the actuator at that point is held in the controller 12 (step 36).

In addition to the advantages of the second embodiment, according to this embodiment, since it is possible to constantly correct the inclination of the passenger cage due to the unbalanced loading to zero, there is no possibility of providing the passengers with uneasiness due to the inclination of the passenger cage when they get therein.

Figure 16:
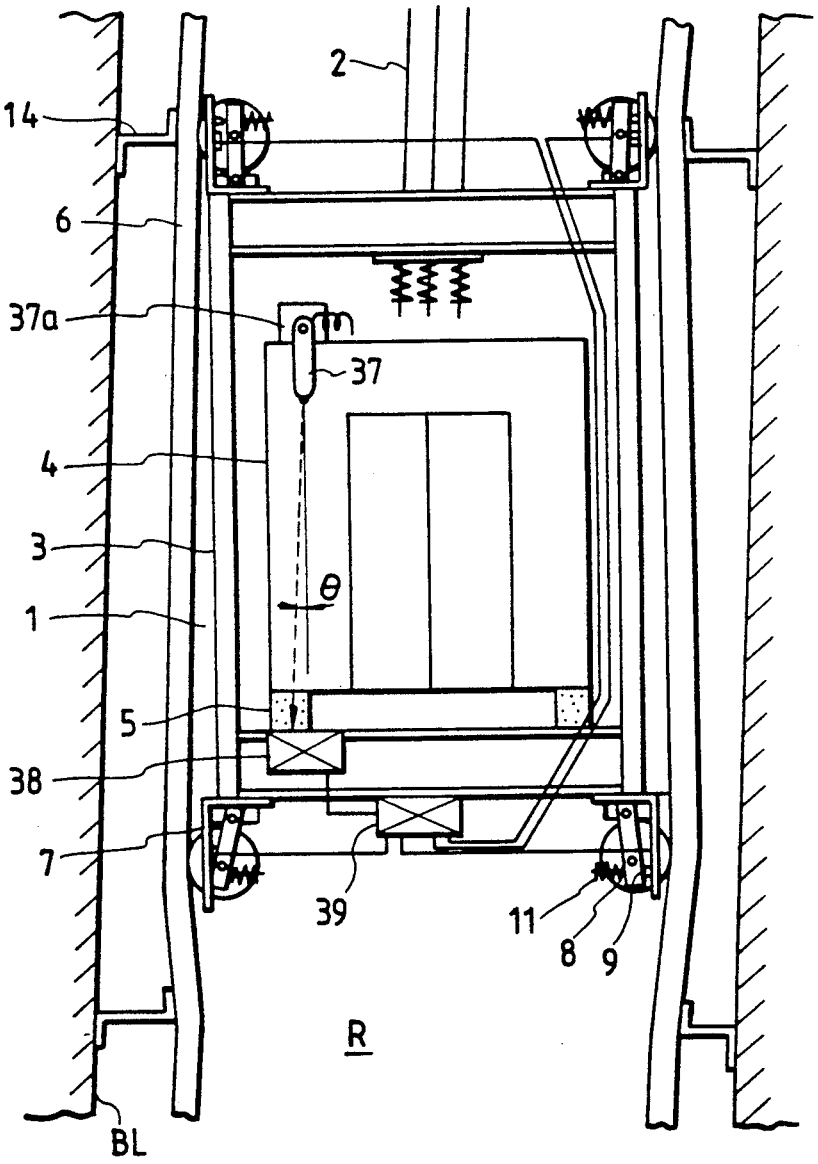
FIG. 16 is a schematic view of an elevator of eighth embodiment according to the present invention.

In the embodiment of FIG. 16, a light source 37 and an optical sensor 38 for detecting the deviation from the perpendicularity of the passenger cage 4 are provided in place of the displacement sensor 10*b* of the elastic member in the second embodiment. The light source 37 is disposed in such a manner so as to face vertically downwardly with a pin 37*a* as a fulcrum, and the optical sensor 38 continuously detects the light receiving position and the deviation of the passenger cage 4 from the perpendicular position. The angle $\theta$ of inclination of the passenger cage is detected from the detected deviation and the distance between the light source 37 and the optical sensor 38. On the basis of the detected angle $\theta$, a main controller 39 obtains the signal values which are necessary for controlling the actuators of the four guiding portions so as to reduce the angle of inclination to zero. These signal values are supplied to the actuators 9 of the four guiding portions so as to operate them.

In addition to the advantages of the second embodiment, according to this embodiment, it is possible to reduce the number of sensors, thereby simplifying the structure of the apparatus.

The guide rollers which are in contact with the guide rails of the guiding portions in the above embodiments may be replaced with sliding shoes without sacrificing the advantages.

As has been explained above, according to the present invention, since it is possible to keep the force applied to the guiding devices constant even if the bend on the guide rails gradually increases with time, or the unbalanced load changes at every travel depending upon the number of passengers, the transversal vibration is greatly reduced, thereby enabling the passengers to trust themselves to the elevator.

We claim:

1. An elevator apparatus having guide rails erected in an elevator shaft of a building and a passenger cage provided with guiding devices in contact with said guide rails and moving upwardly and downwardly along said guide rails, wherein at least two guiding devices are provided on and under said passenger cage, each of said guiding devices being provided with an actuator for applying a pressure between said guide rails and the guiding device, an actuator controller for controlling the actuator, a sensor for detecting a pressure caused by the actuator and an elastic member, provided in parallel with the actuator for absorbing a pressure applied from said guide rail to said guiding device, and wherein the pressure applied to each of said guiding devices is kept constant by said actuator in correspondence with an output of said sensor.

2. An elevator apparatus according to claim 1, wherein said guiding device has a roller or a sliding shoe as a member which comes into contact with said member and said passenger cage.

3. An elevator apparatus having guide rails erected in an elevator shaft of a building and a passenger cage provided with guiding devices in contact with said guide rails and moving upwardly and downwardly along said guide rails, wherein at least two guiding devices are provided on and under said passenger cage, each of said guiding devices being provided with an actuator, an actuator controller and a sensor, a pressure applied to each of said guiding devices is kept constant by said actuator in correspondence with an output of said sensor, and wherein said actuator is controlled so that the pressure acting between said guiding devices and said guide rails is maintained constant in not more than a forced vibration frequency band determined by a length of said guide rail or a space between guide rail attaching brackets.

4. An elevator apparatus according to claim 1, wherein means for locking said actuator when the power supply is suspended or when said elevator is stopped is provided.

5. An elevator apparatus according to claim 1, wherein said actuator is controlled by said controller while said passenger cage is traveling.

6. An elevator apparatus having guide rails erected in a elevator shaft of a building and a passenger cage provided with guiding devices in contact with said guide rails and moving upwardly and downwardly along said rails, wherein at least two guiding devices are provided on and under said passenger cage, each of said guiding devices being provided with an actuator, an actuator controller and a sensor, a pressure applied to each of said guiding devices being maintained constant by said actuator in corresondence with an output of said sensor, and wherein said actuator is operated as an electric damper when a traveling speed of said passenger cage is not more than a predetermined value, or when the pressure applied to said sensor has exceeded a predetermined value for a continuous predetermined time.

7. An elevator apparatus according to claim 1, wherein said actuator is released from control when a power supply to said actuator is interrupted.

8. An elevator apparatus according to claim 1, wherein said actuator is provided with a stopper for regulating the movement which leaves a predetermined range.

9. An elevator apparatus having guide rails erected in an elevator shaft of a building and a passenger cage provided with guiding devices in contact with said guide rails and moving upwardly and downwardly along said guide rails, wherein at least two guiding devices are provided on and under said passenger cage, each of said guiding devices being provided with an actuator, an actuator controller and a sensor, a pressure applied to each of said guiding devices is kept constant by said actuator in correspondence with an output of said sensor, and wherein said actuator is so controlled by said actuator controller that when said passenger cage is stopped, an inclination of said passenger cage is canceled, and an attitude of said passenger cage with said inclination canceled is maintained during upward and downward travel of said passenger cage.

10. An elevator apparatus according to claim 1, wherein said actuator is controlled by the differentiated value of the output of said sensor.

11. An elevator apparatus according to claim 1, wherein said actuator is controlled by said controller when the output of said sensor is in a predetermined range.

12. An elevator apparatus according to claim 1, wherein a pair of guide rails are erected in the elevator shaft of the building, the passenger cage is adapted to move upward and downward between said pair of guide rails and guiding devices are provided on a top and bottom of said passenger cage so as to contact the respective guide rails.

13. An elevator apparatus having a pair of guide rails erected in an elevator shaft of a building and a passenger cage provided with guiding devices in contact with said pair of guide rails and moving upwardly and downwardly along said pair of guide rails, wherein at least two guiding devices are provided on and under said passenger cage, each of said guiding devices being provided with an actuator, an actuator controller and a sensor, a pressure applied to each of said guiding devices is kept constant by said actuator in correspondence with an output of said sensor, the passenger cage is adapted to move upwardly and downwardly between said pair of guide rails and said guiding devices are provided on a top and a bottom of said passenger cage so as to contact the respective guide rails, and wherein a pair of guiding devices are in contact with the same guide rail, and wherein the output of said sensor of a precedent guiding device is used for control of said actuator of a subsequent guiding device.

14. An elevator apparatus having guide rails erected in an elevator shaft of a building and a passenger cage provided with guiding devices in contact with said guide rails and moving upwardly and downwardly along said guide rails, wherein at least two guiding devices are provided on and under said passenger cage, each of said guiding devices being provided with an actuator, an actuator controller and a sensor, a pressure applied to each of said guiding devices is kept constant by said actuator in correspondence with an output of said sensor, and wherein the actuator controller uses the output of the sensor during a halting of the elevator as a reference value and controls the pressure applied to the respective guiding devices during the travel of the elevator so as to be constant.

15. An elevator apparatus having guide rails erected in an elevator shaft of a building and a passenger cage provided with guiding devices in contact with said guide rails and moving upwardly and downwardly along said guide rails, said apparatus comprising a sensor disposed at a part of and precedent to said passenger cage in a traveling direction thereof for detecting a pressure acting between said guide rails and said guiding devices, and means for driving said guiding devices in correspondence with the output of said sensor so as to maintain the pressure acting between said guide rails and said guiding devices constant, whereby said passenger cage moves perpendicularly to its direction of travel, when said passenger cage moves by the precedent distance.

16. An elevator apparatus having guide rails erected in an elevator shaft of a building and a passenger cage provided with guiding devices in contact with said guide rails and moving upwardly and downwardly along said guide rails, said apparatus comprising means for maintaining a force applied from said guide rails to said guiding devices constant in correspondence with an output of a sensor for detecting an inclination of said passenger cage.

* * * * *